US008485375B2

(12) United States Patent
Colloud

(10) Patent No.: US 8,485,375 B2
(45) Date of Patent: Jul. 16, 2013

(54) PLASTIC BOTTLE WITH A CHAMPAGNE BASE AND PRODUCTION METHOD THEREOF

(75) Inventor: Alain Colloud, Reyvroz (FR)

(73) Assignee: SA des Eaux Minerales d'Evian SAEME, Evian-les-Bains (FR)

( * ) Notice: Subject to any disclaimer, the term of this patent is extended or adjusted under 35 U.S.C. 154(b) by 367 days.

(21) Appl. No.: 12/520,455

(22) PCT Filed: Dec. 10, 2007

(86) PCT No.: PCT/FR2007/052468

§ 371 (c)(1),
(2), (4) Date: Jun. 19, 2009

(87) PCT Pub. No.: WO2008/078033

PCT Pub. Date: Jul. 3, 2008

(65) Prior Publication Data

US 2010/0032404 A1 Feb. 11, 2010

(30) Foreign Application Priority Data

Dec. 21, 2006 (FR) ..... 06 11225

(51) Int. Cl.
*B65D 1/02* (2006.01)

(52) U.S. Cl.
USPC ..... 215/375; 220/606

(58) Field of Classification Search
USPC ..... 215/371, 375; 220/606, 608
See application file for complete search history.

(56) References Cited

U.S. PATENT DOCUMENTS

| | | | | | |
|---|---|---|---|---|---|
| 3,871,541 | A | * | 3/1975 | Adomaitis | 215/375 |
| 3,935,955 | A | * | 2/1976 | Das | 215/375 |
| 4,249,667 | A | * | 2/1981 | Pocock et al. | 215/375 |
| 4,267,144 | A | * | 5/1981 | Collette et al. | 264/523 |
| 4,301,933 | A | * | 11/1981 | Yoshino | 215/375 |
| 4,355,728 | A | * | 10/1982 | Ota et al. | 215/375 |
| 4,978,015 | A | * | 12/1990 | Walker | 215/375 |
| 5,064,080 | A | | 11/1991 | Young et al. | |
| 5,198,248 | A | * | 3/1993 | Krishnakumar et al. | 425/522 |
| 5,320,230 | A | | 6/1994 | Hsiung | |

(Continued)

FOREIGN PATENT DOCUMENTS

| | | |
|---|---|---|
| FR | 2 300 707 A1 | 9/1976 |
| FR | 2 471 921 A1 | 6/1981 |

(Continued)

OTHER PUBLICATIONS

International Search Report dated Sep. 10, 2008.

*Primary Examiner* — Tri Mai
(74) *Attorney, Agent, or Firm* — Young & Thompson

(57) ABSTRACT

A plastic bottle includes: a body which extends longitudinally along a central axis from the neck to the lower end thereof and which has a pre-determined thickness, and a base (2) including an apron (3) which is connected to the lower end of the body and which extends to a peripheral bearing area. In addition, a dome (7) extends from the peripheral bearing area to the apex (7*a*) located essentially on the central axis and grooves (9) extend radially between the apron and the dome, the grooves having a base line (9*a*). The direction of the base lines (9*a*) of the grooves forms a sharp angle with the direction tangential to the dome (7) at the point (9*d*) at which the base of the grooves (9) opens into the dome (7).

10 Claims, 3 Drawing Sheets

U.S. PATENT DOCUMENTS

| | | | | | |
|---|---|---|---|---|---|
| 5,713,480 | A | * | 2/1998 | Petre et al. | 215/373 |
| D409,919 | S | * | 5/1999 | Young | D9/520 |
| 6,019,236 | A | * | 2/2000 | Slat | 215/375 |
| RE36,639 | E | * | 4/2000 | Okhai | 215/375 |
| 6,153,145 | A | | 11/2000 | Desoutter et al. | |
| 6,260,724 | B1 | * | 7/2001 | Young et al. | 215/375 |
| 6,299,007 | B1 | * | 10/2001 | Takeuchi | 215/373 |
| D471,452 | S | * | 3/2003 | Bretz et al. | D9/434 |
| 6,672,470 | B2 | * | 1/2004 | Wurster et al. | 215/373 |
| 6,769,561 | B2 | * | 8/2004 | Futral et al. | 215/373 |
| 2003/0196926 | A1 | * | 10/2003 | Tobias et al. | 206/509 |
| 2008/0035601 | A1 | | 2/2008 | Derrien | |

FOREIGN PATENT DOCUMENTS

| | | | |
|---|---|---|---|
| GB | 2 067 160 | A | 7/1981 |
| GB | 2 284 586 | A | 6/1995 |
| WO | WO 03/091117 | A1 | 11/2003 |
| WO | WO 2006/037872 | A1 | 4/2006 |

* cited by examiner

PLASTIC BOTTLE WITH A CHAMPAGNE BASE AND PRODUCTION METHOD THEREOF

This is a national stage application of International Patent Application No. PCT FR2007/052468 filed on Dec. 10, 2007.

The present invention relates to a bottle of the type with a champagne base, that is to say the base of which comprises a dome having a concavity oriented outward, which is designed particularly, but not exclusively, to contain a carbonated drink. More particularly, the invention relates to a plastic bottle comprising a body extending longitudinally along a central axis from a neck to a lower end and having a predetermined thickness, and a base, said base comprising a skirt connected to a lower end of the body and extending to the peripheral bearing zone on which the bottle rests in the vertical position, a continuously rounded dome with a concavity oriented outward and extending from the peripheral bearing zone to an apex situated substantially on the central axis, and grooves having a bottom and extending radially between the skirt and the dome in order to define between them feet of the peripheral bearing zone. The grooves have a longitudinal bottom line extending over the bottom of said grooves in their direction of radial extension.

BACKGROUND OF THE INVENTION

Bases of this type are used for bottles containing carbonated drinks generating a high internal pressure. Specifically, the dome of these bases called "champagne" are well suited for withstanding the internal pressure through its continuously rounded and gentle geometric shape, that is to say without marked relief that may generate concentrations of mechanical stresses. Nevertheless, the connection of this dome with the skirt at the peripheral bearing zone raises problems of stability of the bottle, because, under the effect of the internal pressure, the bearing zone can swell dissymmetrically over an angular portion. This is why it is a known practice to provide peripheral grooves which define feet that are reinforced relative to a continuous annular bearing zone. However, in the prior art, these grooves have been connected to the dome in a tangential manner, that is to say with an orientation of the bottom of the groove forming a virtually flat angle with the tangent of the dome, or else with a large radius of curvature at the connection, for the purpose of not creating a zone of weakness in the dome and consequently being able to reduce its thickness relative to the traditional glass champagne base. But the thickness of the dome is nevertheless still greater than that of the body of the bottle, and this from its apex to the bearing zone in order to also maintain the strength of the dome in its entirety. Such domes provided with reinforcement grooves are known for example from documents FR-A-2 300 707 and WO-A-03/091117.

Champagne bases therefore have the disadvantage of having a relatively high weight due to the presence of a relatively thick dome in order to withstand a given internal pressure. There is a constant concern to reduce the weight of plastic bottles in order to limit the quantity of raw material necessary and to limit the impact of the packaging on the environment.

SUMMARY OF THE INVENTION

The object of the present invention is therefore to optimize the base of a bottle, either to withstand a higher pressure at constant weight, or to reduce the weight of a current base for a given drink.

Accordingly, the subject of the present invention is a bottle of the aforementioned type, characterized in that the bottom line of the grooves has a direction forming a pronounced angle with the direction tangential to the dome at the outlet of the bottom of said grooves in the dome.

It has emerged, notably during tests at 40° Celsius for 72 hours, that bottles made in this way withstood the internal pressure better than earlier comparable bottles. They did so particularly relative to bottles that were similar in terms of dimensions and weight which have a convex petaloid base. In addition, compared with these bases, the height of the grooves separating the feet is substantially reduced and the esthetic appearance is improved.

These surprising results can be attributed to two factors. On the one hand, the bottom of the grooves connected with an angle to the dome may make it possible to transmit radial forces to the periphery of the skirt, which would limit the potential for the dome to flatten and would prevent the dome from turning inside out as is sometimes noted. On the other hand, the side walls of the grooves form flanges that are substantially perpendicular to the dome and extend over the height of a lower portion of the latter, which would create reinforcements similar to ribs.

It will be noted however that, to match the grooves to the dome, preference will be given to a rounded profile having a non-zero radius of curvature, rather than a sharp angle. But such a radius of curvature will remain significantly smaller than the characteristic dimensions of the base, and notably than the radius of curvature of the rounded bottom line of the grooves. The directions of the bottom line and of the tangent to the dome are therefore obviously determined at the ends of the rounded connection profile.

The grooves emerge in a lower portion of the dome that is vertically delimited, relative to a top portion of the dome, by the outlet of the bottom of said grooves. According to an additional feature of the invention, the annular lower portion of the dome has a thickness that is substantially equal to the predetermined thickness of the body, while the top portion of the dome has a minimal thickness that is significantly greater than said predetermined thickness. The result of this is a weight saving thanks to the combined effect of the grooves reinforcing this thinner lower portion of the dome.

The variation of thickness between the annular lower portion and the top portion of the dome naturally does not occur in a discontinuous manner, but with a certain progressivity. The thickness of the top portion may be substantially variable and notably increasing toward the apex which corresponds to the point of injection of the preform. However, the thickness of the lower portion does not vary considerably, of the order of a few tens of percents, and reaches a value that is virtually equal to the predetermined thickness at the feet of the bearing zone, unlike champagne bases of the prior art for which a considerable thickness is sought in this bearing zone in order to reinforce it.

In preferred embodiments of the invention, use is also made of one and/or the other of the following arrangements:

- the angle formed between the direction of the bottom of the grooves and the direction tangential to the dome at the outlet is between 90 degrees and 150 degrees, and is preferably equal to 120 degrees; specifically, an angle greater than 150 degrees should not sufficiently block the top portion of the dome while an angle smaller than 90 degrees would cause a use of more material without improving pressure-resistance;
- the bottom line of the grooves has a curved profile with a radius of curvature that increases from the skirt to the dome; in order to form a more pronounced angle at the outlet in the dome than at the outlet in the skirt;

the minimal thickness of the top portion of the dome is equal to at least twice the predetermined thickness, and preferably approximately equal to three times said predetermined thickness; which makes it possible to confer sufficient strength to this portion in which the plastic is stretched less, but nevertheless without excessively increasing the weight of the base;

excluding the apex of the dome corresponding to a point for injection of the plastic, the thickness of the top portion of the dome varies in a range from one to three times the minimal thickness, in order to prevent the accumulation of unnecessary plastic, notably toward the apex;

the apex of the dome comprises a hollow nipple with a concavity oriented outward, which promotes the spreading of the preform about the central axis in order to better distribute the plastic over the top portion of the dome;

the height of the grooves at the outlet in the dome is between 30 and 60% of the height of the dome measured on its outer face, and preferably approximately 40%; which allows a good compromise between saving material, pressure resistance and esthetic appearance;

the bearing zone comprises feet having, in radial section, a rounded profile with a radius of curvature that is significantly less than the minimal radius of curvature of the dome and extending circumferentially over a major portion of the periphery of the bearing zone; the small radius of curvature of the feet increasing their resistance to the bearing force on a support and their total circumferential length spreading this contact force.

A bottle as defined above may advantageously be produced using a manufacturing method, wherein the following are provided:

a standard preform having a cylindrical internal recess terminated by a hemisphere;

a mold with a shape corresponding to the external dimensions of a bottle as defined above, and wherein an operation of blow-molding of the preform is carried out in the mold with a stretch rod in contact with the base of the preform and characterized in that the parameters for blow-molding and advancing the stretch rod are adjusted so as to obtain a thickness in the lower annular portion of the dome that is substantially equal to the predetermined thickness of the body of the bottle, and a minimal thickness of the top portion of the dome that is significantly greater than said predetermined thickness.

By virtue of using a standard preform and the increasing possibilities of adjusting blow-molding parameters, it is particularly easy to switch from production of bottles according to the invention to conventional production, or to handle these two types of production on one site, for example in order to produce a natural water with different degrees of fizziness.

BRIEF DESCRIPTION OF THE DRAWINGS

Other features and advantages of the invention will emerge during the following description, given as a nonlimiting example, with reference to the figures in which:

FIG. 4 is a view in section along the line IV-IV of FIG. 2, whereas

In the various figures, identical reference numerals indicate identical or similar elements.

DETAILED DESCRIPTION

Figure 1:
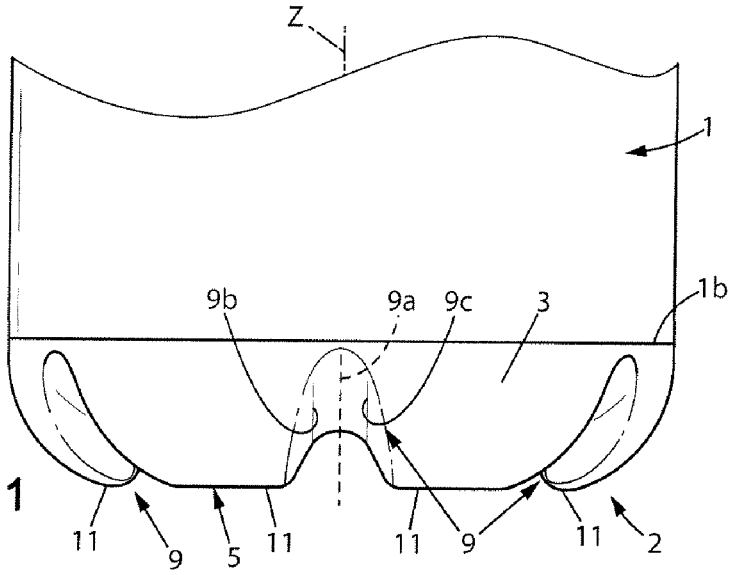
FIG. 1 is a partial front view of a bottle made according to the invention.

FIG. 1 represents partially a bottle designed to contain a carbonated drink. This bottle comprises a body 1 which extends longitudinally on a central vertical axis Z between a top end connected to a neck furnished with a closure system, not shown, and a lower end 1*b*. The lower end of the body 1*b* corresponds to the height of the body from which its cross section reduces in order to form a base 2. The body 1 has a uniform circular cross section, but it could comprise reliefs or flutes and consequently a cross section that is not constant over its whole height.

Figure 4:
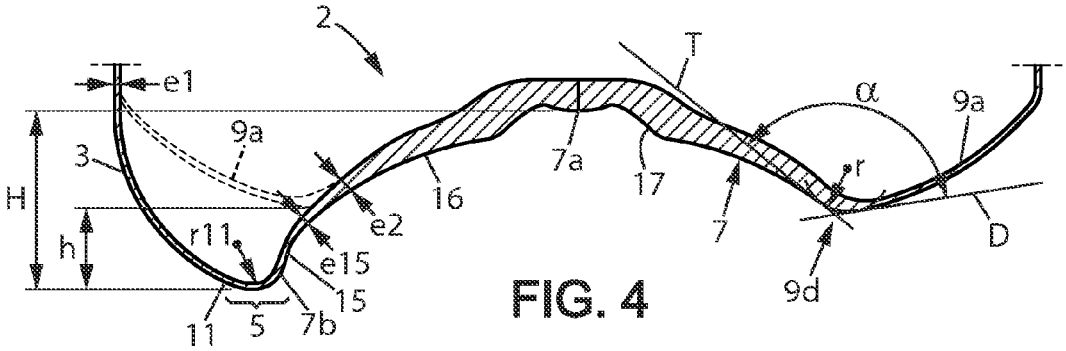

As can be better seen in FIG. 4, the body 1 is formed by a thin wall made of plastic, such as for example a polyester and more particularly PET. The body 1 has a thickness e1 hereinafter called the "predetermined thickness", which is relatively reduced in order to economize on the plastic. As an example, in the embodiment shown, the predetermined thickness is 0.4 mm, but it could vary substantially depending on the internal pressure and the dimensions of the bottle. For a bottle of sparkling water with its contents varying between 25 cl and 2 liters, this thickness may vary between 0.3 and 0.5 mm. It is a body of cylindrical cross section with a diameter of the order of 75 mm, but it could be an ovalized or polygonal cross section.

The base 2 comprises a skirt 3 connected to the lower end 1*b* tangentially to the latter. The skirt 3 extends downward to a peripheral bearing zone 5, that can be seen in FIG. 2, on which the bottle is designed to rest in the vertical position. The external diameter of the skirt 3 decreases from the lower end 1*b* to the bearing zone 5 so that the latter has a diameter that is approximately 30% smaller than the diameter of the body 1. This decrease is in this instance continuous and along the profile of a curve, which promotes its pressure-resistance.

The central portion of the base 2 comprises a dome 7, the apex 7*a* of which is centered on the axis Z. This dome 7 has the general shape of a hemisphere. However, the base 7*b* of the dome connected to the peripheral bearing zone 5 takes a slightly more curved shape than an ideal sphere. In any case, the dome 7 has a continuous rounded profile, except possibly in a region limited to the apex 7*a* as explained below, and preferably with a symmetry of revolution about the axis Z. Specifically, marked discontinuities or changes of direction in the wall of the dome would not allow the latter to withstand the deformations and to transmit the supported pressure to the bearing zone 5.

Grooves 9 extend in a radial direction relative to the central axis Z between the skirt 3 and the dome 7, so that they define between them feet 11 of the peripheral bearing zone 5. In the embodiment shown, these grooves 9 are six in number, but their number could be uneven and vary between 3 and around 10.

As can be seen in the left half-view of FIG. 4, the skirt 3 and the dome 7 are connected together by the feet 11 of the peripheral bearing zone 5, which have a rounded profile with radii that are very significantly greater than the thickness of the wall in this zone and much smaller than the radii of curvature r11 of the dome 7. Therefore, each foot 11 has a rounded radial profile of constant thickness. The rounded profile of the feet 11 has a small radius of curvature, significantly smaller than the minimal radius of curvature of the dome, which allows them to withstand, without deformation, much greater pressures than a flat bearing zone.

It will be noted that the circumferential width of the grooves 9 is constant over their radial extension and less than the circumferential width of the feet 11 arranged between the latter. All of the feet 11 therefore extend circumferentially over a major portion of the periphery of the bearing zone 5 on which the weight of the bottle rests.

The cross section of the grooves 9 has the shape of a V with a rounded bottom. Consequently, it is possible to define, on these grooves, a bottom 9*a* having the shape of a line represented in dashed lines in FIGS. 1 to 3. On either side of this bottom line 9*a* the side walls (9*b*, 9*c*) of the grooves extend. The same would apply with grooves having a U-shaped profile.

The bottom of each groove 9 comes out in the dome 7 at a zone 9*d* called the outlet. This outlet 9*d* is defined as a zone, and not a point, because each groove 9 is connected to the dome 7 via a connection profile with a radius of curvature r, and not a sharp angle. This is so naturally for the purpose of not creating concentrations of stresses. But it will be noted that this radius of curvature r is very slight, notably relative to the radius of curvature of the rounded bottom line 9*a* of the grooves or else of the dome 7, and more than ten times less than these radii. Therefore, when consideration is given to the bottom 9 of a groove and the wall of the dome 7 in this outlet zone 9*d*, the latter form an angle α between them, except for the radius of curvature of the connection.

Figure 5:
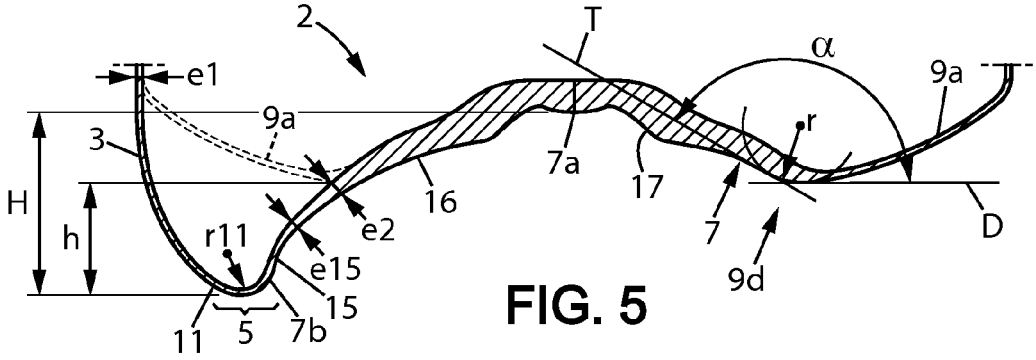
FIG. 5 and FIG. 6 show respectively other embodiments for the base according to a section view similar as FIG. 4.
Figure 6:
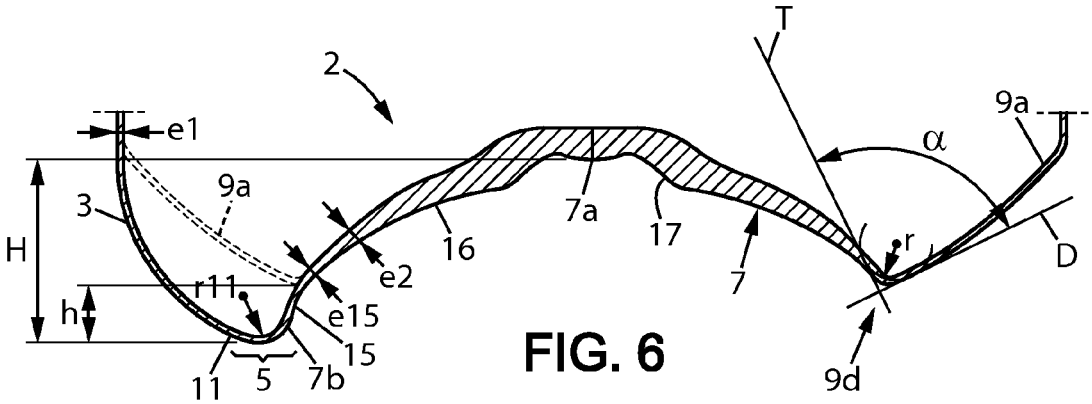

More precisely, the direction D of the bottom line 9*a* of a groove 9 forms, with the tangent to the dome T, oriented toward the central axis Z, a pronounced angle α at the outlet 9*d*, that is to say at the ends of the connection profile with the radius r connecting these zones. "Pronounced angle" should be understood to be an angle of at least a few tens of degrees more than a closed angle and less than a flat angle. Preferably, this angle α is between 90 degrees and 150 degrees and preferably approximately 120 degrees, as in the embodiment shown in FIG. 4. An angle α of about 150 degrees can be seen in the embodiment shown in FIG. 5 and an angle α of about 90 degrees can be seen in the embodiment shown in FIG. 6.

Figure 2:
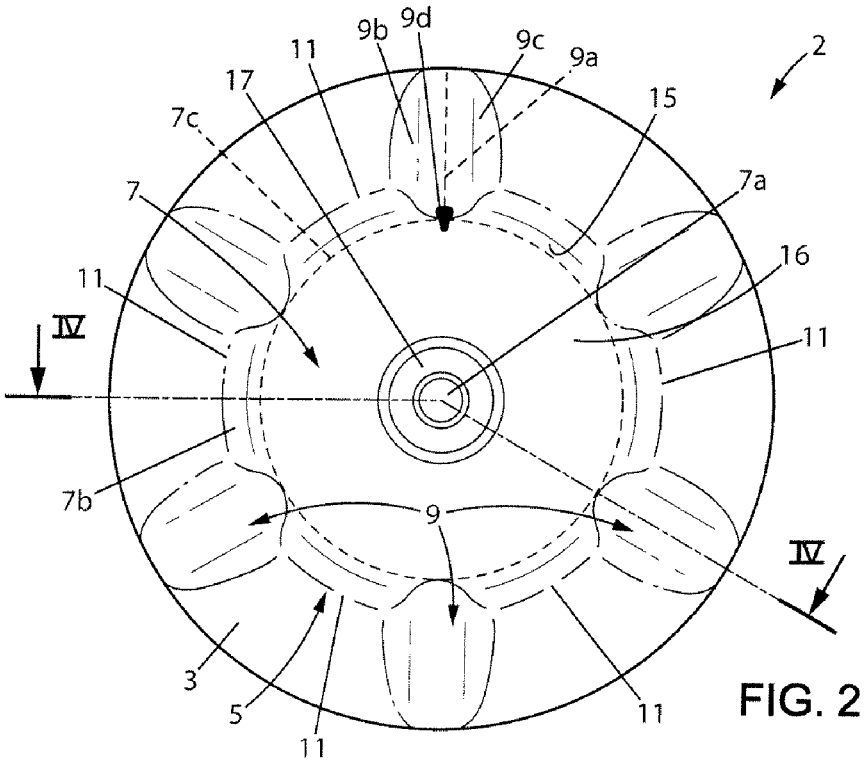
FIG. 2 is a view from below of FIG. 1.
Figure 3:
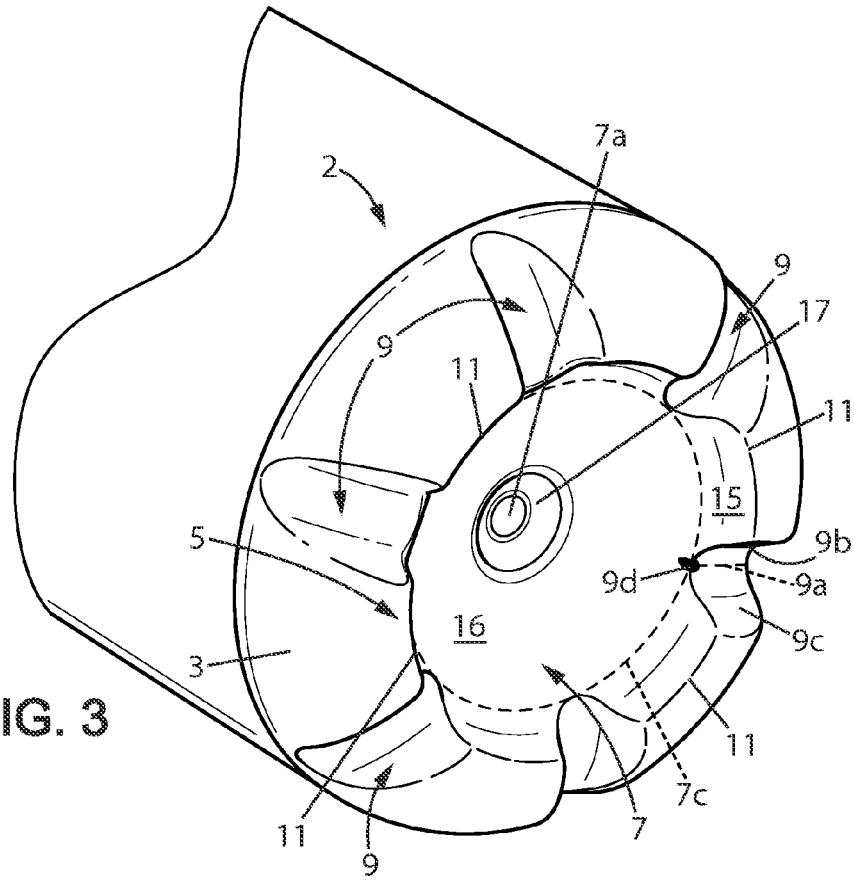
FIG. 3 is a view in perspective from below of FIG. 1.

All of the outlets 9*d* of the bottoms of the grooves define a virtual line 7*c*, represented in dashed lines in FIGS. 2 and 3. This line of separation 7*c* delimits the dome 7 at a lower portion 15 extending to the peripheral bearing zone 5, and a top portion 16 extending from this line 7*c* to the apex 7*a* of the dome. The lower portion 15 therefore corresponds to an annular surface into which the grooves 9 open. It will be noted that the geometric characteristics indicated are defined with reference to the external surface of the base 2, because this external surface is defined precisely by a mold, while the internal surface is obtained by deformation under the pressure of the hot air injected during the blow-molding operation and therefore more subjected to variations of geometry.

It appears that this arrangement of the grooves 9 relative to the dome 7 improves the internal pressure-resistance of the base 2. It would seem that, on the one hand, the bottom of each of the grooves 9 forms a rigid spacer extending to the periphery of the skirt 3 which would make it possible to radially immobilize the dome 7 at the line of separation 7*c* and therefore prevent a flattening of the top portion 16. Such an immobilization could not be obtained with groove bottoms connected to the dome in a tangential manner or by a large radius of curvature. On the other hand, the side walls (9*b*, 9*c*) form flanges that are substantially perpendicular to the lower portion 15 of the dome and have a considerable width from their line of connection, unlike flanges that widen in the case of grooves connected in a tangential manner to the dome. This arrangement of the grooves 9 does not increase the weight of the base 2 relative to the prior base comprising a thick dome, but increases the internal pressure-resistance. The pressure-resistance/weight ratio of the base is therefore increased.

Nevertheless the profile of the bottom lines 9*a* of the grooves is not necessarily rectilinear in order to play this role of spacer transmitting the forces. Specifically, as in the embodiment shown, it can be advantageous to have the bottom lines 9*a* of the grooves extend longitudinally on a curved line having a radius of curvature that increases from the skirt 3 to the dome 7, that is to say similar to the shape of a comma. This allows a more tangential connection of the grooves 9 at the apex of the skirt 3 where the depth of the grooves diminishes, while the profile of the bottom lines 9*a* of the grooves is closer to a straight line at the dome 7.

In addition, this arrangement of the grooves 9 can be advantageously combined with a judiciously chosen local reduction in the thickness of the dome 7 in order to also obtain a weight reduction of the base 2. Specifically, as can be seen in FIG. 4, the lower portion 15 of the dome has a thickness e15, that is substantially constant, which is very markedly less than the average thickness of the top portion 16 of the dome, and even than the minimal thickness e2 of this top portion. Therefore, in addition to the increased resistance, it is possible to obtain a reduction in the weight of the base. More particularly, the thickness e15 of the lower portion 15 of the dome is substantially constant and approximately equal to the predetermined thickness e1 of the wall of the body.

It will be noted however that it is not a question of producing a sudden change of thickness in the form of a circular ridge at the line of separation. It is therefore necessary to understand that the thickness e15 of the lower portion 15 and the minimal thickness e2 of the top portion 16 of the dome is a thickness measured slightly away from the line of separation 7*c*, as indicated in FIG. 4 by the references e15 and e2. Nevertheless, this thickness transition is sufficiently marked to be visible to the naked eye in the form of a change in opacity of the dome 7.

It will be noted that the thickness of the skirt 3, but also of the feet 11 of the peripheral bearing zone 5 and of the wall of the grooves 9, is also substantially constant and equal to the predetermined thickness e1 of the body. This arrangement, which may be ascertained by a transparency beyond the line of separation 7*c* that is virtually identical to the transparency of the body, allows a substantial weight saving of the base 2 for a given pressure-resistance. This saving is substantial when the thickness e15 of the lower portion 15 is at least half of the minimal thickness e2 of the top portion 16. A good compromise is obtained in the embodiment shown with a thickness e15 of the lower portion 15 that is approximately equal to a third of the minimal thickness e2 of the top portion 16. Or, in other words, when the minimal thickness e2 of the top portion 16 of the dome 7 is approximately equal to three times the predetermined thickness e1 of the body 1.

Naturally, it is possible to reduce the weight of the base 2 by economizing on the material used to form the top portion 16 of the dome, by limiting the maximum thickness of the top portion of the dome relative to its minimal thickness e2. By improving the stretching and the spreading of the plastic of the preform in order to obtain a variation in the maximum thickness relative to the minimal thickness e2 in a ratio at most equal to 3, the weight of the top portion 16 of the dome is greatly optimized. For the maximum thickness, the zone of the apex 7*a* of the dome which usually corresponds to a point of injection of the plastic into the preform centered on the axis Z is however excluded, because it is virtually impossible to obtain a stretching in this zone.

Those skilled in the art will understand that the greater the height h of the bottom of the grooves 9 at the outlets 9*d*, the more extended is the lower portion 15 of the dome and therefore the greater the weight saving. Nevertheless, this height cannot approach the height H of the dome, measured at its apex 7*a*, otherwise it would form a connection angle α that is flat reducing the immobilization effect of the grooves and risking posing problems of pressure-resistance of the grooves 9 themselves, notably at their side face (9*b*, 9*c*). In addition, by increasing the height h of the bottom of the grooves, their visual impact is increased. A good compromise between these requirements can be obtained with a height h of the bottom of the grooves 9 at their outlet 9*d* of between 30 and 60% of the height H of the dome 7, and preferably of approximately 40% as in the embodiment shown.

For the purpose of obtaining a good spread of the plastic in the top portion 16 of the dome 7, a hollow nipple 17 is provided at the apex 7*a* of the dome and has a concavity oriented outward like the dome. When the plastic of the blow-molded preform first comes into contact with this nipple 17, it sustains a first stretching that is more pronounced than if it encountered a perfectly hemispherical dome, because of the smaller radius of curvature of this nipple 17. The nipple 17 forms an indent relative to the overall rounded profile of the dome 7, but it does not reduce the pressure-resistance of the dome 7 in its entirety because the thickness of material is still considerable in this slightly stretched central zone.

The production of the external geometric shapes indicated above is easily obtained by the shape of the mold in which the bottle is blow-molded. The question of obtaining the indicated thicknesses, and more particularly the transition of thickness between the lower and top portions (15, 16) of the dome, requires more expertise and testing by those skilled in the art. For example, it is known practice to use preforms having substantial local thickness variations in order to obtain determined thicknesses in certain zones by the blow-molded bottle. But the test campaigns that have been run have shown that it was totally possible to obtain the optimum thicknesses by adjusting the parameters of the bottle blow-molding operation, while using a perfectly standard preform, that is to say in which the internal space of the preform has the shape of a cylinder terminated by a hemisphere. As a reminder, the blow-molding operation consists mainly in preheating a preform, placing it in a mold with the shapes of the bottle and with dimensions much larger than the preform, blowing in a hot gas at a determined temperature, pressure and flow rate, while accompanying, and even assisting, the expansion of the preform with a stretch rod in contact with the base of the preform. These operations are carried out in a more or less complex sequence and by providing a greater or lesser cooling of the mold. In addition, the adjustment of these parameters during tests, then in production, can be carried out precisely thanks to an increasingly sophisticated computerized inspection. Using a standard preform notably has the advantage of simplifying the starting of production of the bottles according to the invention and if necessary returning to a production of other types of bottle. In addition to the economies of scale on the purchase of preforms, this also allows simpler management of procurement and stocks on a production site where various drinks are bottled that are more or less carbonated and that therefore require bottles with different pressure-resistances.

The embodiment described is in no way limiting, the geometric indications given being able to vary substantially depending on the volume and the cross section of the bottle, and depending on the nature of the drink. For this reason, it should be noted that the bottle produced according to the invention can be perfectly suited to liquids that are not gassy, such as, for example, still water, which can be packaged under pressure and create a very high pressure wave on the base if the bottle should fall.

The invention claimed is:

1. A plastic bottle comprising a body extending longitudinally on a central axis from a neck to a lower end and having a predetermined thickness, and a base, said base comprising:

feet having, in a radial section, a rounded profile;

a skirt connected to said lower end of the body and extending to a peripheral bearing zone;

a dome with a concavity oriented outward, the dome extending from said peripheral bearing zone to an apex situated substantially on the central axis, the dome having an outer face and a height measured on said outer face, the apex of the doame comprising a hollow nipple with a concavity oriented outward, the dome being continuously rounded below the apex; and grooves having a bottom and extending radially between said skirt and said dome, the grooves having a longitudinal bottom line extending over the bottom of said grooves in their direction of radial extension, said bottom line extending at a distance from the peripheral bearing zone, wherein said base of the plastic bottle is a champagne base, wherein the grooves are each connected to the dome via a connection profile, said bottom line of the grooves has a direction forming a pronounced angle with the direction tangential to said dome at the outlet of the bottom of said grooves in the dome, the height of said grooves at said outlet being between 30 and 60% of said height of the dome, said outlet being distant from the hollow nipple, and wherein said angle is between 90 degrees and 120degrees.

2. The bottle as claimed in claim 1, wherein said angle is equal to 120 degrees.

3. The bottle as claimed in claim 1, wherein the dome has a top portion and a lower portion, said grooves emerging only in said lower portion of the dome, and wherein the lower portion of the dome has a thickness that is substantially equal to the predetermined thickness, while the top portion of the dome has a minimal thickness that is significantly greater than said predetermined thickness.

4. The bottle as claimed in claim 3, wherein said minimal thickness of the top portion of the dome is equal to at least twice the predetermined thickness.

5. The bottle as claimed in claim 4, wherein said minimal thickness is approximately equal to three times said predetermined thickness.

6. The bottle as claimed in claim 3, wherein, at a distance from the apex of the dome, the thickness of the top portion of the dome varies in a range from one to three times said minimal thickness.

7. The bottle as claimed in claim 1, wherein said apex of the dome comprises a hollow nipple with a concavity oriented outward.

8. The bottle as claimed in claim 1, wherein said height of said grooves is approximately 40%.

9. The bottle as claimed in claim 1, wherein said bearing zone comprises the feet, the feet extending circumferentially over a major portion of the periphery of the bearing zone.

10. A plastic bottle comprising a body extending longitudinally on a central axis from a neck to a lower end and having a predetermined thickness, and a base, said base comprising:

feet having, in radial section, a rounded profile;

a skirt connected to said lower end of the body and extending to a peripheral bearing zone;

a dome with a concavity oriented outward, the dome extending from said peripheral bearing zone to an apex situated substantially on the central axis, the dome having an outer face and a height measured on said outer face, the apex of the dome comprising a hollow nipple with a concavity oriented outward, the dome being continuously rounded below the apex; and grooves having a bottom and extending radially between said skirt and said dome, the grooves having a longitudinal bottom line extending over the bottom of said grooves in their direction of radial extension, said bottom line extending at a distance from the peripheral bearing zone, wherein said base of the plastic bottle is a champagne base, wherein the grooves are each connected to the dome via a connection profile, said bottom line of the grooves has a direction forming a pronounced angle with the direction tangential to said dome at the outlet of the bottom of said grooves in the dome, the height of said grooves at said outlet being between 30 and 60% of said height of the dome, said outlet being distant from the hollow nipple, and wherein said angle is more than 120 degrees and less than 150 degrees.

* * * * *

UNITED STATES PATENT AND TRADEMARK OFFICE

CERTIFICATE OF CORRECTION

PATENT NO. : 8,485,375 B2
APPLICATION NO. : 12/520455
DATED : July 16, 2013
INVENTOR(S) : Alain Colloud It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 437 days.

Signed and Sealed this
Eighth Day of September, 2015

Michelle K. Lee

Michelle K. Lee
*Director of the United States Patent and Trademark Office*